US005402869A

United States Patent [19]

Saltzman et al.

[11] Patent Number: 5,402,869

[45] Date of Patent: * Apr. 4, 1995

[54] MAIN CARRYING BAG WITH DETACHABLE SECONDARY BAG

[76] Inventors: Lita Saltzman; Alan T. Saltzman, both of 8102 E. Bucknell Pl., Denver, Colo. 80231

[ * ] Notice: The portion of the term of this patent subsequent to May 10, 2011 has been disclaimed.

[21] Appl. No.: 207,036

[22] Filed: Mar. 4, 1994

Related U.S. Application Data

[63] Continuation of Ser. No. 1,373, Nov. 12, 1992, Pat. No. Des. 346,693.

[51] Int. Cl.[6] ..... A45C 13/36

[52] U.S. Cl. ..... 190/108; 150/113

[58] Field of Search ..... 190/108, 109, 110; 383/37, 38; 150/113, 114

[56] References Cited

U.S. PATENT DOCUMENTS

| | | | |
|---|---|---|---|
| D. 263,899 | 4/1982 | Lynn . | |
| D. 293,508 | 1/1988 | Marconi . | |
| D. 299,384 | 1/1989 | Donnor . | |
| D. 346,693 | 5/1994 | Saltzman et al. | D3/42 |
| 2,451,718 | 10/1948 | Corrao | 248/105 |
| 2,544,618 | 3/1951 | Smith | 150/147 X |
| 2,631,288 | 3/1953 | Daust | 2/49 |
| 3,061,057 | 10/1962 | Miller | 190/110 |
| 3,122,225 | 2/1964 | Ward | 190/108 |
| 3,696,850 | 10/1972 | Rosenblum | 150/33 |
| 3,829,995 | 8/1974 | Fakoury | 150/147 X |
| 3,830,348 | 8/1974 | Ohyama | 190/110 X |
| 3,955,609 | 5/1976 | Siegel | 150/114 X |
| 4,081,061 | 3/1978 | Tucker | 190/108 |
| 4,436,189 | 3/1984 | Baum | 190/108 |
| 4,442,960 | 4/1984 | Vetter | 190/108 X |
| 4,566,130 | 1/1986 | Contes | 383/15 |
| 4,663,779 | 5/1987 | Bible | 2/49 R |
| 4,779,288 | 10/1988 | Mack | 2/49 R |
| 4,781,277 | 11/1988 | Lim | 190/1 |
| 4,793,004 | 12/1988 | Long et al. | 2/49 R |
| 4,811,428 | 3/1989 | Waldman et al. | 2/49 R |
| 4,860,381 | 8/1989 | Bartley | 2/49 A |
| 4,886,150 | 12/1989 | Fitzsimmons | 190/1 |
| 4,995,436 | 2/1991 | Cantor | 150/102 |
| 5,050,713 | 9/1991 | Lee | 190/108 |
| 5,062,557 | 11/1991 | Mahvi et al. | 224/153 |
| 5,160,001 | 11/1992 | Marceau | 190/902 X |
| 5,186,290 | 2/1993 | Takayama | 190/108 |
| 5,230,450 | 7/1993 | Mahvi et al. | 224/153 |
| 5,312,282 | 5/1994 | Cooper | 446/27 |

FOREIGN PATENT DOCUMENTS

| | | |
|---|---|---|
| 3600794 | 1/1986 | Germany . |
| 840343 | 7/1960 | United Kingdom . |

*Primary Examiner*—Allan N. Shoap
*Assistant Examiner*—Christopher McDonald
*Attorney, Agent, or Firm*—Pravel, Hewitt, Kimball & Krieger

[57] ABSTRACT

A dual-bag having a first, primary, diaper bag and a second, secondary mother's bag detachably secured to the first primary bag. One of side surfaces of the first, primary bag has first zipper-securing means, and one of the side surfaces of the second, secondary bag has second, cooperating zipper-securing means, for removably mounting the second, secondary bag to the first bag.

13 Claims, 2 Drawing Sheets

MAIN CARRYING BAG WITH DETACHABLE SECONDARY BAG

CROSS REFERENCE TO RELATED APPLICATION

This is a continuation of application Ser. No. 29/001,373, filed on Nov. 12, 1992, now U.S. Pat. Des. No. 346,693.

BACKGROUND OF THE INVENTION

The present invention is directed to a main carrying bag, such as a diaper bag, and the like, and a secondary bag that is detachably secured to the main carrying bag. It has been known to provide a dual bag for suitcases, where a main bag has detachably secured thereto another bag.

In the preferred embodiment of the invention, the main carrying bag is a diaper bag, in which may be stored and transported diapers and supplies associated therewith, while the detachable, secondary bag is a mother's bag, which serves as a purse, or the like, for storing items therein which the mother desires. The main objective is to allow for the secondary bag to be detached from the main bag, so that the main bag may be posited with the baby at one location, such as a day-care, child-care provider, health club nursery, and the like, while the mother's bag may be detached and carried by the mother as her purse, when she leaves the location.

SUMMARY OF THE INVENTION

It is the primary objective of the present invention to provide a pair of bags, where one is the main bag, and where one is the secondary bag that is detachably secured to the main bag, so that the secondary bag may be separated from, and carried independently of, the main bag, when so desired.

It is another objective of the present invention to provide such a dual bag, where the detachable, secondary bag is removably secured to the main bag by two zippers, wherein the pulls of the zippers remain attached to the main bag, so that when the secondary bag is separated and used as a handbag, or purse, there are no dangling zipper-pulls which could interfere with the clothing of the person carrying the handbag.

It is yet another objective of the invention to provide an identifying plate on the main bag, which identifies the person, such as a baby, associated with the bag, and which also identifies important information about the person or baby, which identifying plate is hidden from view for security reasons when the two bags are connected together, so that the information is available to other persons only when the bags are separated, such as when a mother leaves her baby at a day care center, or the like.

It is also an objective of the invention to provide carrying straps for the dual-bag of the invention only on the main bag, so that when the bags are separated, the main bag may be still carried by the same carrying straps, and the detached secondary bag may be carried as a purse.

BRIEF DESCRIPTION OF THE DRAWINGS

The invention will be more readily understood with reference to the accompanying drawing, wherein.

DETAILED DESCRIPTION OF THE INVENTION

Figure 7:
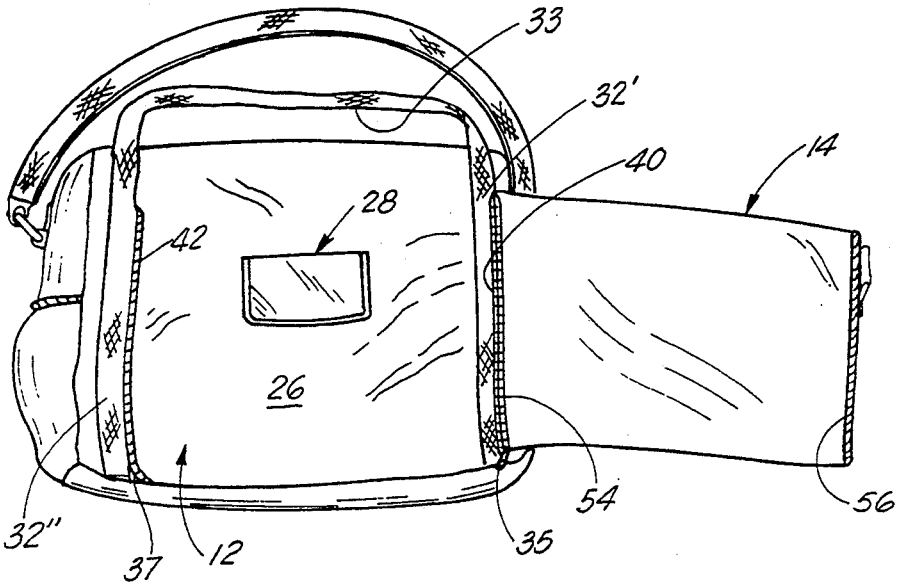
FIG. 7 is a side view similar to FIG. 3 but showing the secondary bag partially detached from the main bag, which exposes an identification tag area on the side surface of the main bag.
Figure 8:
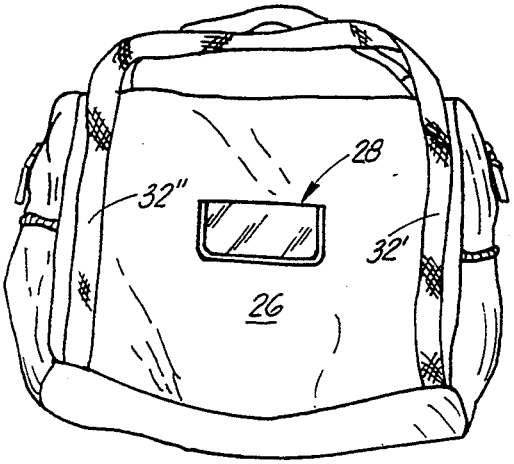
FIG. 8 is a side view of the main bag after the secondary bag has been completely detached therefrom.
Figure 9:
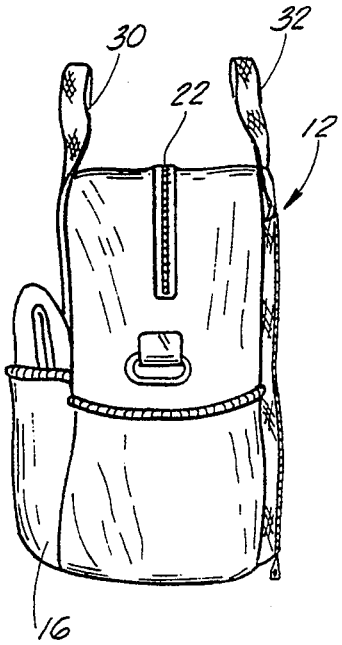
FIG. 9 is an end view of the separate, detached main bag and secondary bag.
Figure 10:
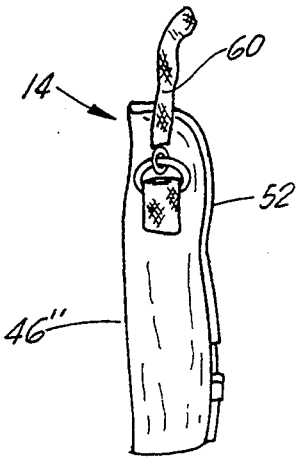
FIG. 10 is side view of the detached secondary bag.
Figure 10:
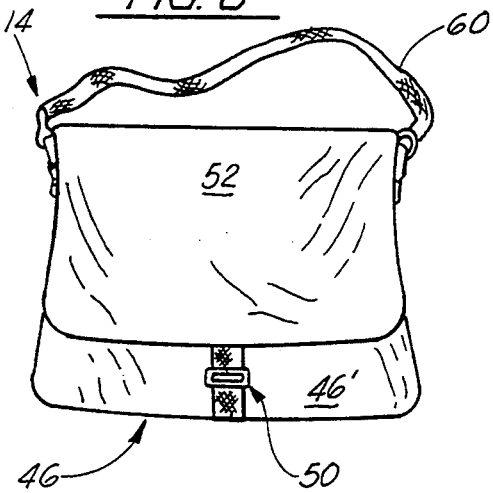

Referring now to the drawing in greater detail, the combined, double-bag of the invention is indicated generally as reference numeral 10. The double-bag 10 includes a main, or primary, carrying bag 12, and a secondary, carrying bag 14, which is detachably secured to the main carrying bag 12. The main carrying bag is preferably larger than the secondary bag, and includes a number of pocket or storage areas, such as those indicated by reference numerals 16, 18, 20. The main bag 12 has a main body portion 12' which defines a hollow interior that is accessible via zipper-closure 22 on the upper surface of the main body portion 12'. The main body portion 12' also has a first side surface 24 from which pocket 16 is connected, and a second side surface 26 to which is detachably secured the secondary carrying bag 14, as described below in detail. This second side surface 26 has an identifying tag or plate section , or pocket 28, as best seen in FIGS. 7 and 8, which receives therein a card or plate, or the like, having identifying information thereon. Such information may be name and address, as well as vital medical information relevant to the owner of the bag or the owner's baby . This identifying section 28 is hidden from view when the secondary bag is attached to the main bag, so that, under normal use, the information contained therein may be kept secret. In the preferred embodiment, where the main bag 12 is a diaper bag, and the secondary bag serves as a mother's handbag or purse, the information on the identifying area 28 will be relevant to the baby, and has especial use as when the mother leaves the baby at day care centers or playgroups. Since the diaper bag is left at the playgroup or day care center, the necessary information about the baby is exposed on the identifying section 28, after the mother has removed her hand bag 14, and has left the premises.

Figure 1:
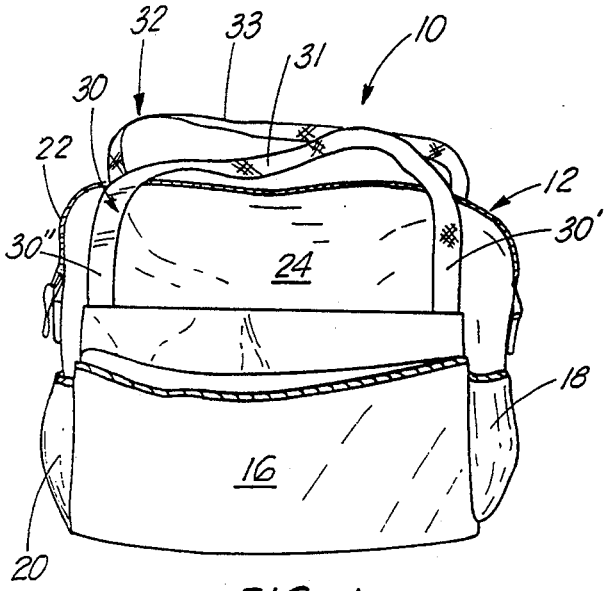
FIG. 1 is a first side view of the main carrying bag with detachable secondary bag of the invention.
Figure 2:
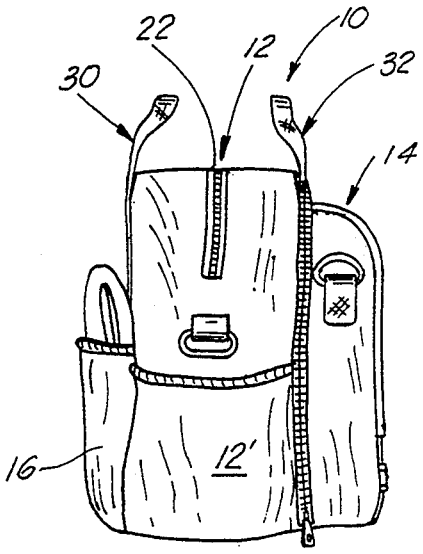
FIG. 2 is a first end view thereof.
Figure 3:
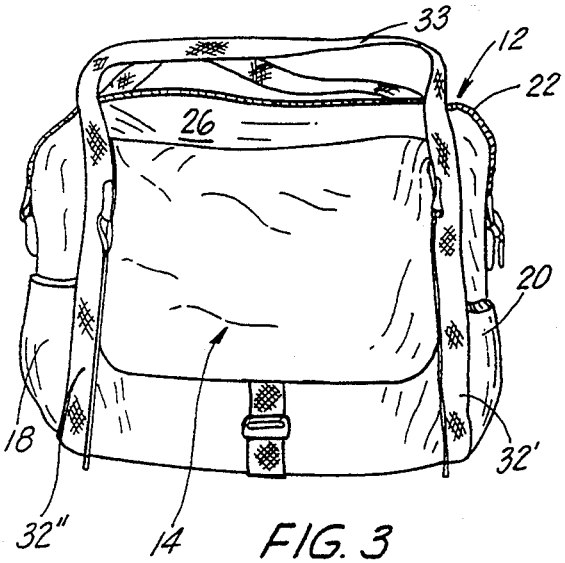
FIG. 3 is a second side view thereof.
Figure 4:
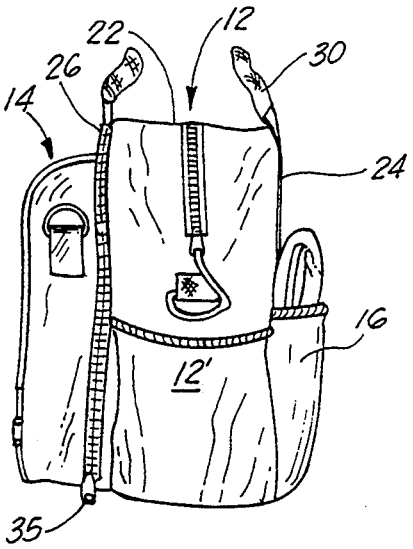
FIG. 4 is a second end view thereof.
Figure 5:
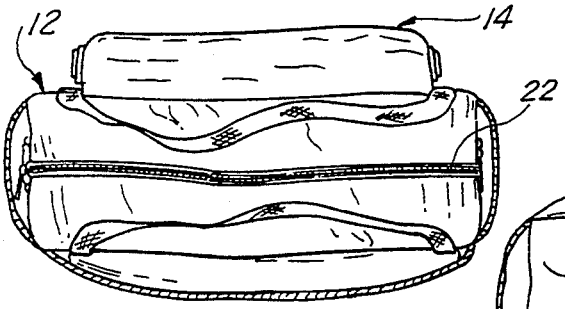
FIG. 5 is a top view thereof.
Figure 6:
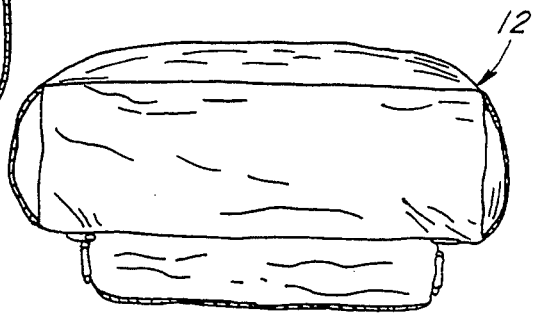
FIG. 6 is a bottom view thereof;.

The main bag 12 also has a pair of hand-straps 30, 32, the strap 30 being associated with side surface 24 and the strap 32 being associated with side surface 26. As can be seen in FIG. 1, the strap 30 has vertical sections 30', 30'' that are permanently stitched to the side surface 24, leaving a hand-gripping section 31 free for gripping. The strap 32 has vertical legs 32', 32'' that are permanently stitched to the side surface 26, as best seen in FIGS. 3, 7 and 8, leaving a hand-gripping section 33 free for gripping. The legs 32', 32'' extend substantially down the entire width of the side surface 26. Connected to the interior edge-surfaces of each vertical leg section 32', 32'' is a zipper-strip section 40, 42, respectively, which zipper-strip sections are used in cooperation with mating sections on the secondary bag, for removably and detachably securing the secondary bag 14 to the main bag 12. These zipper-strip sections are located on the interior edge-surfaces of the vertical legs 32', 32" in order that these leg sections will serve as strengtheners and reinforcers; this location of the zipper-strip sections 40, 42 also ensures that the straps 30, 32 are connected only to the main carrying bag, so that, when the secondary bag is detached from the main bag, these straps 30, 32 are still used for carrying the main bag, which is typically the heavier and larger of the two bags. Moreover, since the secondary bag does not have any strap associated therewith, it is may thereby be more like a woman's purse in style. Each of these zipper-strips sections 40, 42 also has a puller 35, 37, respectively, associated therewith, which pullers 35, 37, in a conventional fashion, unite these zipper-strip sections 40, 42 of the main bag 12 with mating zipper-strip sections on the secondary bag. These pullers remain attached to the main bag, so that the secondary bag does not have any zipper-pulls thereon, both for stylish reasons and for utilitarian reasons, since zipper-pulls on the secondary bag would tend to interfere with, or get caught on, other garments worn by the user of the detached, secondary bag, or could make annoying noise when moving about. The zipper-strip sections 40, 42 are arranged to operate in the opposite manner from each other. That is, the zipper-pull 35 must be pulled up, when viewing FIG. 7, in order to separate the mating zipper-strips sections 40,54 from each other when detaching the secondary bag from the primary bag, while the zipper-pull 37 must be pulled down, when viewing FIG. 7, in order to separate the mating zipper-strips sections 42, 56 from each other when detaching the secondary bag from the primary bag. This opposite-mounting of the zipper-strip sections ensures, firstly, that the zipper-pulls 35, 37 remain attached to the primary bag 12, for the reasons given above, and secondly, allows for easier attachment of the secondary bag to the primary bag, since, one zipper-pull is accessed from above while the other is accessed from below, providing a greater degree of freedom for connecting the zipper-sections.

The secondary bag 14, as best seen in FIGS. 3, 4, 9 and 10, has a main body portion 46 defining a hollow interior, and defines a first side surface 46' and a second side surface 46". The side surface 46' faces away from the main bag 12 when the two bags are attached, and has a male buckle 50, or the like, that cooperates with a female element attached to a cover flap 52, that is used for closing off the bag 14, in a conventional manner. The second side surface 46" is provided with the mating zipper-strip sections 54, 56 for the zipper-strip sections 40, 42. These zipper-strip sections 54, 56 are located at the extreme, vertical side-edges of the second surface 46", as best seen in FIG. 7, so that the zipper-pulls 35, 37 may engage therewith. The secondary bag 14 may have a detachable carrying strap 60, if desired, in the well-known manner.

While a specific embodiment of the invention has been shown and described, it is to be understood that numerous changes and modifications may be made therein without departing from the scope, spirit and intent of the invention as set forth in the appended claims.

What we claim is:

1. A dual-bag comprising:

a first, primary bag comprising a main body portion having a first side surface, a second side surface, and a hollow interior;

a second, secondary bag detachably secured to said first primary bag, said second, secondary bag comprising a first side surface and a second side surface, and a hollow interior;

one of said first and second side surfaces of said first, primary bag having first cooperating securing means thereon, and one of said first and second side surfaces of said second, secondary bag having second cooperating securing means thereon, said first and said second cooperating securing means removably mounting said second, secondary bag to said first, primary bag for selective detachment and attachment therefrom;

said first cooperating securing means comprising a pair of parallel, spaced-apart, first zipper-strip sections, and said second cooperating securing means comprises a pair of second, parallel, mating zipper-strip sections located on said one of said first and second side surfaces of said second, secondary bag spaced apart so as to mate with said pair of first zipper-strip sections;

said first, primary bag comprising a pair of carrying straps, a first said carrying strap being permanently associated with said first side surface of said first, primary bag, and a second said carrying strap being permanently associated with said second side surface of said first, primary bag; said first carrying strap having a pair of spaced-apart, vertical leg-sections permanently secured to said first side surface of said first, primary bag, and said second carrying strap also having a pair of spaced-apart, vertical leg-sections permanently secured to said second side surface of said first, primary bag, whereby, when said first and second bags are detached from each other, said carrying straps are used as carrying straps for the first, primary bag; each said leg-section of each said pair of vertical leg-sections of said carrying straps defining an interior edge-surface facing toward the interior edge-surface of the other of said leg-sections of the respective said pair; said pair of parallel, first zipper-strip sections being located at said interior edge-surfaces of said leg-sections of said first carrying strap, whereby said pair of parallel, first zipper-strip sections are reinforced thereby.

2. The dual-bag according to claim 1, wherein said pair of parallel, first zipper-strip sections are spaced apart a distance substantially equal to the width of said second, secondary bag.

3. The dual-bag according to claim 1, wherein said pair of second, mating zipper-strip sections located on said one of said first and second side surfaces of said second, secondary bag are located at the lateral, vertical edge-surfaces of said one of said first and second side surfaces of said second, secondary bag.

4. The dual-bag according to claim 1, wherein each said first zipper-strip section of said pair of first zipper-strip sections comprises a sliding zipper-pull for engagement with a respective one of said pair of second zipper-strip sections, whereby no zipper-pulls are located on said second, secondary bag when said second, secondary bag is detached from said first, primary bag.

5. The dual-bag according to claim 3, wherein said first zipper-strip sections of said pair of first zipper-strip sections are oriented opposite to each other, whereby a respective said sliding zipper-pull of one said first zipper-strip section is slid oppositely to that of the other respective said first zipper-strip section when said zipper-pulls engage and mate with the respective said second zipper-strip sections of said pair of second zipper-strip sections, whereby the attachment and detachment of the second, secondary bag to and from said first, primary bag is expedited.

6. The dual-bag according to claim 1, wherein said first primary bag is much larger than said second, secondary bag, said second, secondary bag serving as a woman's purse when detached from said first, primary bag.

7. The dual-bag according to claim 1, wherein said one side surface of said first, primary bag comprises an identification-area for displaying required information about the owner of the bag, and the like; said identification-area being hidden from view by said second, secondary bag when said second, secondary bag is attached to said first, primary bag; said identification-area being located between said interior edge-surfaces of said pair of leg-sections of said first carrying strap.

8. A dual-bag apparatus comprising:

a) a primary bag comprising a main body portion having a first side surface, a second side surface, and a hollow interior;

b) a secondary bag detachably secured to said primary bag, said secondary bag comprising a first side surface and a second side surface, and a hollow interior;

c) said first side surface of said primary bag having first cooperating securing means thereon, and one of said first and second side surfaces of said secondary bag having second cooperating securing means thereon, said first and said second cooperating securing means removably mounting said secondary bag to said primary bag for selective attachment to and detachment therefrom;

d) said first cooperating securing means comprising a pair of parallel, spaced-apart, first zipper-strip sections, and said second cooperating securing means comprises a pair of second, mating zipper-strip sections located on said one of said first and second surfaces of said secondary bag, spaced apart so as to mate with said pair of first zipper-strip sections;

e) a pair of carrying straps including, a first said carrying strap being permanently associated with said first side surface of said primary bag, and a second said carrying strap being permanently associated with said second side surface of said primary bag;

f) said first carrying strap having a pair of spaced-apart, vertical leg-sections having interior edge surfaces, permanently secured to said first side surface of said primary bag, and said second carrying strap also having a pair of spaced-apart, vertical leg-sections permanently secured to said second side surface of said primary bag, whereby when said first and secondary bags are detached from each other, said carrying straps are used as carrying straps for the primary bag;

g) said pair of parallel, first zipper-strip sections being positioned adjacent said interior edge-surfaces of said leg-sections of said first carrying strap; and h) an enlarged exterior pocket supported on said second side surface of said primary bag and covering at least half of said second side surface, the pocket extending transversely to attachment positions adjacent said vertical leg sections of second carrying strap.

9. The apparatus of claim 8 further comprising a strap attachment means on each bag and further comprising a shoulder strap that cam be selectively attached to either the primary or secondary bag at the strap attachments thereon.

10. A dual-bag apparatus comprising:

a) a first larger bag comprising a main body portion having a first side surface, a second side surface, a pair of end surfaces and a hollow interior;

b) a second smaller bag detachably secured to said first larger bag, said smaller bag having a first side surface, a second side surface, and a hollow interior;

c) said first side surface of said first larger bag having first cooperating securing means thereon, and one of said first and second side surfaces of said second smaller bag having second cooperating securing means thereon, said first and said second cooperating securing means removably mounting said second smaller bag to said first larger bag for selective attachment to or detachment therefrom;

d) a pair of carrying straps, including a first said carrying strap being permanently associated with said first side surface of said first larger bag, and a second said carrying strap being permanently associated with said second side surface of said first, larger bag;

e) said first carrying strap having a pair of spaced-apart, leg sections permanently secured to said first side surface of said first larger bag, and said second carrying strap also having a pair of spaced-apart, leg sections permanently secured to said second side surface of said first larger bag;

f) said first cooperating securing means being positioned adjacent said first carrying strap leg sections; and g) a pocket on said second side surface of said first larger bag and covering at least half of said second side surface of said larger bag, the pocket extending transversely to attachment positions adjacent said vertical leg sections of said second carrying strap.

11. The dual bag apparatus of claim 10 further comprising at least one external bottle pocket positioned at one of the end surfaces of the larger bag and including an open top.

12. The apparatus of claim 10 further comprising a strap attachment means on each bag and further comprising a shoulder strap that can be selectively attached to either the primary or secondary bag at the strap attachments thereon.

13. The apparatus of claim 11 wherein there are a pair of bottle pockets positioned respectively on the pair of end surfaces of the larger bag.

* * * * *